United States Patent [19]

Westerholm

[11] 4,002,277

[45] Jan. 11, 1977

[54] SKI TOTE DEVICE

[75] Inventor: Wayne P. Westerholm, Redondo Beach, Calif.

[73] Assignee: The Raymond Lee Organization, Inc., New York, N.Y. ; a part interest

[22] Filed: May 14, 1975

[21] Appl. No.: 577,435

[52] U.S. Cl. ..... 224/45 S; 280/11.37 A

[51] Int. Cl.[2] ..... A45C 71/00

[58] Field of Search ..... 224/55, 52, 54, 45 P, 224/45 Q, 49, 45 S, 5 Z, 1 A, 1 R, 25, 57, 56, 51, 53; 294/78, 81 R; 280/11.37 A

[56] References Cited

UNITED STATES PATENTS

| | | | |
|---|---|---|---|
| 899,806 | 9/1908 | Rieder | 224/57 |
| 3,120,403 | 2/1964 | Molzan et al. | 294/74 |
| 3,187,967 | 6/1965 | Somple | 224/1 A |
| 3,278,097 | 10/1966 | Duckworth | 224/45 S |
| 3,334,794 | 8/1967 | Saari et al. | 224/1 R |
| 3,486,672 | 12/1969 | Esopi | 224/45 S |
| 3,675,835 | 7/1972 | Wilson | 224/45 S |
| 3,774,826 | 11/1973 | Raihill | 224/55 |

FOREIGN PATENTS OR APPLICATIONS

| | | | |
|---|---|---|---|
| 165,453 | 3/1950 | Germany | 280/11.37 A |
| 383,257 | 12/1964 | Switzerland | 224/55 |
| 612,628 | 5/1946 | United Kingdom | 224/57 |

*Primary Examiner*—Robert J. Spar
*Assistant Examiner*—Kenneth Noland
*Attorney, Agent, or Firm*—Daniel Jay Tick

[57] ABSTRACT

Each of a plurality of sling type members supports skis in spaced relation with the other sling type members. Each sling type member comprises a strip of flexible material having bores formed through both ends so that when the strip supports skis as a sling the bores are in alignment. Straps pass through a handle of tubular configuration and extend from the handle at both ends. Fasteners are provided at the ends of the straps for releasably fastening each end of the straps to a corresponding one of the sling type members via the bores thereof to support skis supported by the members via the handle.

1 Claim, 3 Drawing Figures

SKI TOTE DEVICE

DESCRIPTION OF THE INVENTION

The present invention relates to a ski tote device. More particularly, the invention relates to a ski tote device for carrying skis and ski poles.

Objects of the invention are to provide a ski tote device of simple structure, which is inexpensive in manufacture, used with facility and convenience and functions efficiently, effectively and reliably as a tote for carrying skis and ski poles by hand in the same manner as an article of luggage.

In order that the invention may be readily carried into effect, it will now be described with reference to the accompanying drawing, wherein.

Figure 1:
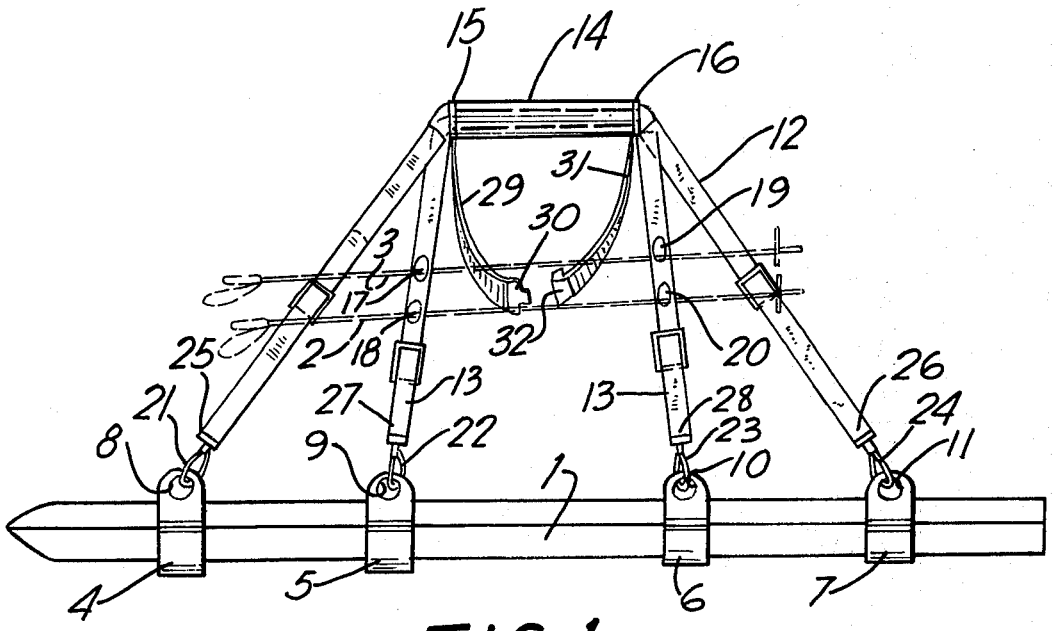
FIG. 1 is a view of an embodiment of the ski tote device of the invention.
Figure 2:
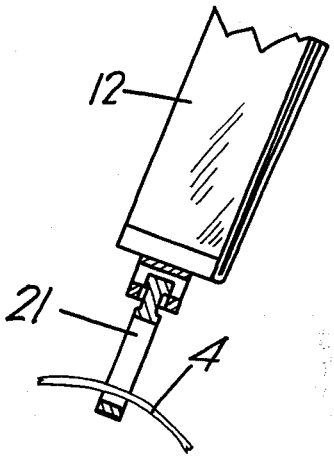
FIG. 2 is a sectional view, on an enlarged scale, of a fastening device of the ski tote device of the invention.
Figure 3:
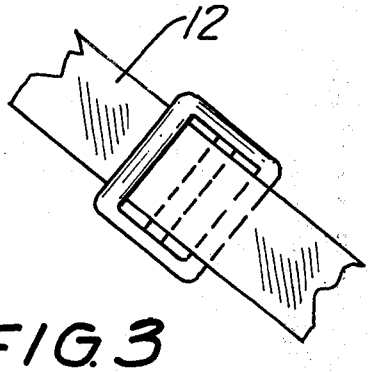
FIG. 3 is a view, on an enlarged scale, of part of a strap of the ski tote device of the invention.

The ski tote device of the invention is for carrying skis 1, and so on, and ski poles 2 and 3 (FIG. 1).

The ski tote device of the invention comprises a plurality of sling type members 4, 5, 6 and 7, each supporting skis 1, and so on, in spaced relation with the other sling type members. Each sling type member 4, 5, 6 and 7 comprises a strip of flexible material such as, for example, plastic, having bores formed through both ends so that when the strip supports skis as a sling, as shown in FIG. 1, the bores are in alignment. The bores 8, 9, 10 and 11 of the sling type members 4 to 7, respectively, are shown in FIG. 1.

A pair of adjustable straps 12 and 13 pass through a handle 14 of substantially tubular configuration and extend from the handle at both ends 15 and 16 thereof (FIG. 1). The strap 13 has four holes 17, 18, 19 and 20 formed therethrough in positions whereby the ski poles 2 and 3 are supported by said strap via said holes and the handle 14, as shown in FIG. 1.

Fastening devices 21, 22, 23 and 24, constituting snap fasteners of any suitable known type, are provided at the ends of the straps 12 and 13 for releasably fastening each end of the straps to a corresponding one of the sling type members 4 to 7 via the bores 8 to 11 thereof to support the skis 1, and so on, by said members via the handle 14, as shown in FIG. 1. Thus, as shown in FIG. 1, the ends 25 and 26 of the strap 12 are releasably fastened to the sling type members 4 and 7 via the snap fasteners 21 and 24. The ends 27 and 28 of the strap 13 are releasably fastened to the sling type members 5 and 6 via the snap fasteners 22 and 23.

A strap length 29 extends from the end 15 of the handle 14 and has a buckle component 30 affixed to the free end thereof. A strap length 31 extends from the end 16 of the handle and has a buckle component 32 affixed to the free end thereof. The buckle components 30 and 32 are used to couple the strap lengths 29 and 31 to each other to provide a shoulder carrying strap in place of the handle 14.

While the invention has been described by means of a specific example and in a specific embodiment, I do not wish to be limited thereto, for obvious modifications will occur to those skilled in the art without departing from the spirit and scope of the invention.

I claim:

1. A ski tote device for carrying skis and ski poles, said ski tote device comprising a plurality of sling type members each supporting skis in spaced relation with the other sling type members and each comprising a strip of flexible material having bores formed through both ends so that when the strip supports skis as a sling the bores are in alignment;

a handle of substantially tubular configuration;

a pair of straps passing through the handle and extending from the handle at both ends, each of the straps having spaced opposite first and second ends, each of the straps comprising an adjustable strap, one of said straps having a plurality of holes formed therethrough in positions whereby ski poles are supported by said one of the straps via the holes and the handle; and fastening means at the first and second ends of each of the straps for releasably fastening each end of each of the straps to a corresponding one of the sling type members via the bores thereof to support skis supported by said members via the handle.

* * * * *